United States Patent [19]

Giuffre et al.

[11] Patent Number: 5,054,225

[45] Date of Patent: Oct. 8, 1991

[54] GUNSIGHT FLEXIBILITY AND VARIABLE DISTANCE AIMING APPARATUS

[76] Inventors: Kenneth A. Giuffre; Carmelo A. Giuffre, both of 201 Sagamore La., Franklin Lakes, N.J. 07417

[21] Appl. No.: 484,343

[22] Filed: Feb. 23, 1990

[51] Int. Cl.[5] ..... F41G 1/38

[52] U.S. Cl. ..... 42/101; 89/41.17; 33/245

[58] Field of Search ..... 42/100, 101; 33/233, 33/235, 234, 245; 89/41.17, 41.19; 364/76, 77, 79; 434/20

[56] References Cited

U.S. PATENT DOCUMENTS

| | | | |
|---|---|---|---|
| 1,300,688 | 4/1919 | Ballard | 42/100 |
| 3,453,385 | 7/1969 | Capellaro | 42/100 |
| 4,534,735 | 8/1985 | Allard et al. | 434/20 |
| 4,878,305 | 11/1989 | Gabrielidis | 42/100 |
| 4,936,190 | 6/1990 | Pilcher | 89/41.17 |
| 4,955,812 | 9/1990 | Hill | 434/20 |

FOREIGN PATENT DOCUMENTS

| | | | |
|---|---|---|---|
| 0160123 | 11/1985 | European Pat. Off. | 434/20 |
| 8503118 | 7/1985 | World Int. Prop. O. | 434/20 |

*Primary Examiner*—Michael J. Carone
*Attorney, Agent, or Firm*—McGlew & Tuttle

[57] ABSTRACT

A gunslight aiming device which employs various methods of image transmission to allow the user of a weapon to be positioned at various locations spaced from the weapon thereby permitting a wider variety firing positions, faster aiming between firing, and accurate aiming regardless of the relationship between head and aiming eye(s) and weapon. The arrangement provides a transmission mechanism preferably in the form of a flexible fiber optic cable which is coupled to a standard optical sight by a coupling mechanism which conditions the signal for transmission by the flexible optic trunk. The image is again conditioned at a second coupling arrangement for viewing by the user.

1 Claim, 4 Drawing Sheets

GUNSIGHT FLEXIBILITY AND VARIABLE DISTANCE AIMING APPARATUS

BACKGROUND OF THE INVENTION

1. Field of the Invention

The present invention relates to scopes for firearms or gunsights generally and more particularly to an optical arrangement for guns while in the aiming of the gun without acquiring predetermined disposition of the person firing the gun with respect to the gun.

2. Description of Prior Art

Rifles and other guns currently in use utilize a variety of optical systems mounted on the weapon to aid the user in aiming more precisely at the target. Most known arrangements normally magnify the view of the target. Such optical systems can be calibrated with extreme precision. The precision of the systems has recently been improved by incorporating laser and infrared technology in helping reliably locate targets in all modes of ambient lighting. These systems require that the user position his head in such a way that certain markers within the device line up with the target and the eye used to aim. Such systems such as the system disclosed in U.S. Pat. No. 4,390,276 also include rigid collimator devices for undeviated viewing from objective to ocular.

SUMMARY OF THE INVENTION

It is an object of the invention to provide a device for allowing a person firing a gun, rifle, or similar weapon, to use a precision aiming device (also known as a scope or gunsight) without the need to maintain a constant distance from the head position in relation to the optical portion of the aiming device by using an optical instrument connected in close proximity to the aiming eye of the user which by flexible fiber optic, wire, or wireless telemetry, allows that user to move his head in any manner desired; only limited by the length or range of said device and (or) the maintenance of control of said weapon.

The invention provides a device which allows the user of a firearm such as a gun, rifle, or laser to obtain the benefits of an optical aiming system precisely mounted to the weapon, the ocular end of which, is connected to a flexible optical transmission device whose distal end is connected in close enough proximity to the user's aiming eye, or connected to an electronic image transmission system capable of converting the optical image into an electronic signal which is then transported over wire or electromagnetically to a receiver also in close proximity to the user's head and aiming eye(s) so as to reproduce the image that the user would see if he had lined his head up with the optical aiming system without the optical transmission device.

A variety of flexible optical devices are currently in use, particularly in the fields of medicine, referred to generically as fiber optics, in which the user is capable of transmitting or receiving undeviated visual signals with great accuracy while the device is flexed and bent in any random configuration that its flexible structural integrity will allow (e.g. U.S. Pat. Nos. 3,807,390; 4,295,470 which are hereby incorporated by reference). Such devices have further utilized advanced technologies for automatic image enhancement (e.g. U.S. Pat. Nos. 4,141,624 and 4,618,884 which are hereby incorporated by reference). These devices have seen great use in observing hard to reach body cavities as the flexibility of the systems used allow the user to obtain optical data from the vascular system etc.

Within this field, a variety of portable electronic devices capable of reproducing a visual image at a remote location electronically either alone or in combination with a fiber optics-type system have also been developed. Such devices are capable of utilizing wires and even electromagnetic waves to transmit such images in an analog or digital fashion to a remote location (e.g. U.S. Pat. Nos. 4,875,093; 4,863,233; 4,807,025; 4,807,026; 4,473,841; 4,074,306 each of which is hereby incorporated by reference).

The receiving or ocular end of such a transmission device can be supported by any means such as a helmet, headband, etc., or can be self supporting. Eyeglass-mounted viewing devices for difference optical systems have been utilized such as the device described by U.S. Pat. No. 4,649,434 which is hereby incorporated by reference.

The device according to the invention includes advantageous features which are quite useful to the improvement of accuracy of already implemented gunsight devices. The inventive arrangement minimizes motion artifact allowing faster aiming and more rapid recovery of aim between firings. The inventive arrangement eliminates the need to precisely line up the viewing eye(s) and head with the guns and optical instrument thereby allowing further freedom and flexibility in the position in which the weapon is fired and even offering possible protection to the user involved in a warfare situation. The inventive arrangement also allows the user of smaller firearms more stability while aiming.

It is an object of the invention to increase precision and accuracy of a firearm or weapon such as a rifle or handgun by avoiding movement artifact often produced by head motion before firing.

It is a further object of the invention to facilitate continued accuracy in firing of the weapon while in awkward positions where the head is not optimally lined up with the optical aiming system or where the head is in danger of assault by another weapon or projectile.

Still another object of the invention is to facilitate faster recovery from rifle recoil between shots by eliminating the time required to realign the head with the optical aiming system and to facilitate firing of the weapon from places which offer more protection to the user.

Yet another object of the invention is to increase accuracy in firing small weapons (e.g. pistols) by removing the need to align the weapon with the head via an outstretched and hence, more unstable arm.

Still another object of the invention is to provide a flexible optical transmission device which may be coupled to a standard gunsight and to provide for the attachment of the distal end of the flexible optical device to any piece of head or eye gear.

It is a further object of the invention to employ video technology as an alternative to flexible optical transmission devices resulting in a wire or wireless telemetry connecting aiming eyepiece to a weapon optical aiming device.

According to the invention, a gunsight aiming apparatus as provided comprising a standard optical sight which is fixed to the firearm for providing an image of an object at which the firearm is directed and an image transmission arrangement including image transmission means for transmitting light representing the image or a signal representing the image to a viewer provided at a location spaced away from said optical sight. The transmission means is preferably in the form of a fiber optic line such as a flexible fiber optic trunk which may be connected to the optical sight via a coupling arrangement. The coupling arrangement preferably includes an ocular mechanism for conveying light from the optical sight to the fiber optic trunk. The light leaving the trunk at the viewing end may be reconstituted or focussed at a second coupling arrangement which connects the fiber optic trunk to the viewer ocular end.

According to a second embodiment of the invention, a coupling arrangement is provided which senses light from an image provided by an optical sight and converts the sensed light into an electrical signal. The transmission means is provided in the form of an electrical conductor for receiving the electrical signal, representative of the image, and transmitting the signal to a viewing location. A viewer mechanism is provided at the viewing location and is connected to the conductor by a viewing side coupling arrangement. The viewing side coupling arrangement and the viewer mechanism may be in the form of a cathode ray tube or the like or other known viewing arrangements such as a liquid crystal display or the like.

According to another embodiment of the invention, a coupling arrangement is provided for an optical sight which senses an image provided by the sight and converts the image into an electrical signal or the like wherein the transmission means includes a transmitter connected to the coupling arrangement for transmitting the signal representing the optical image to the remote viewing location. A receiving arrangement is provided at the remote viewing location to perceive the signal representing the optical image provided by the optical sight and for outputting an electrical signal representing the image. The signal may then be converted for viewing by using a cathode ray tube arrangement, a LCD arrangement or the like.

The invention also provides a method for aiming a firearm or the like including coupling an image transmitting arrangement to an optical sight of a firearm and providing a viewing arrangement at a position that is spaced away from the optical sight of the firearm and transmitting a signal or light from the coupling arrangement to the viewer for viewing an object at which the fire arm is directed at a location spaced away from the fire arm.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
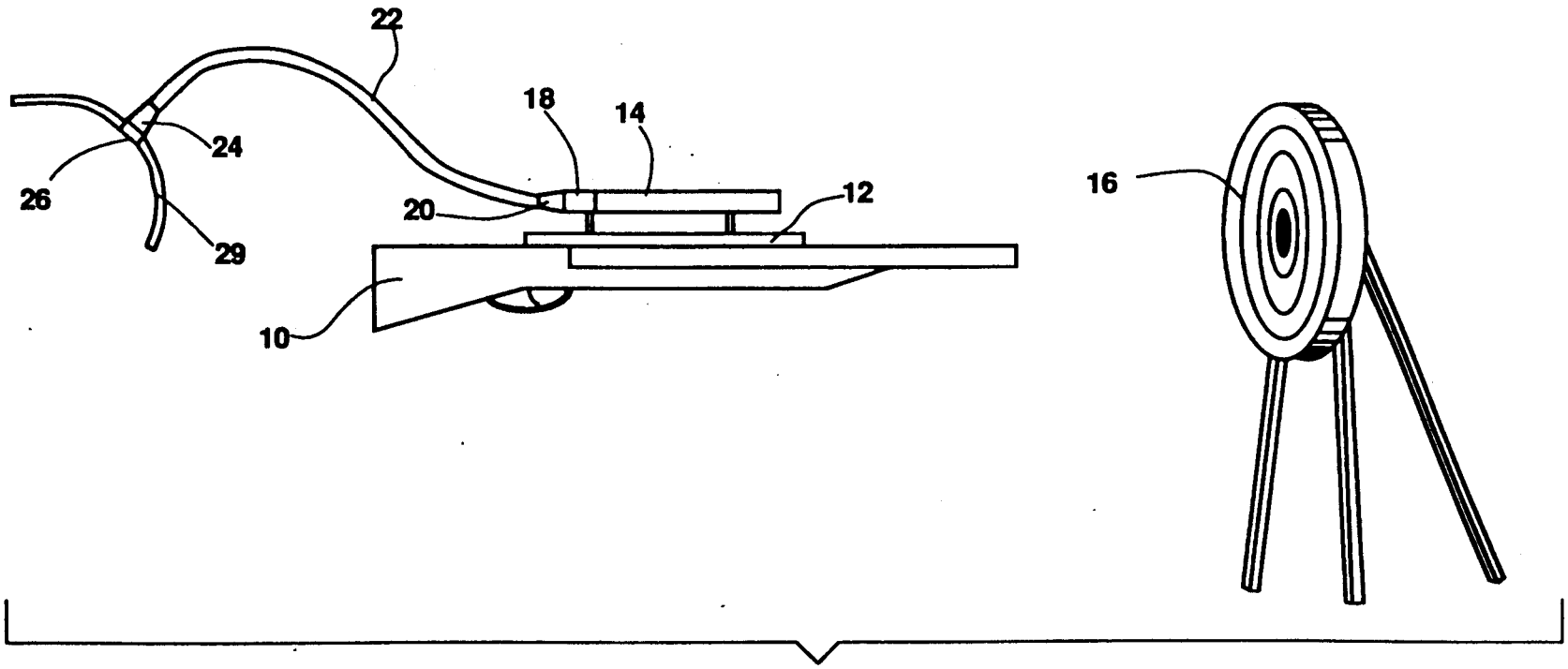
FIG. 1 is a schematic view showing a gunsight flexibility and variable distance aiming apparatus lined up with a possible target and mounted on a firearm.
Figure 2:
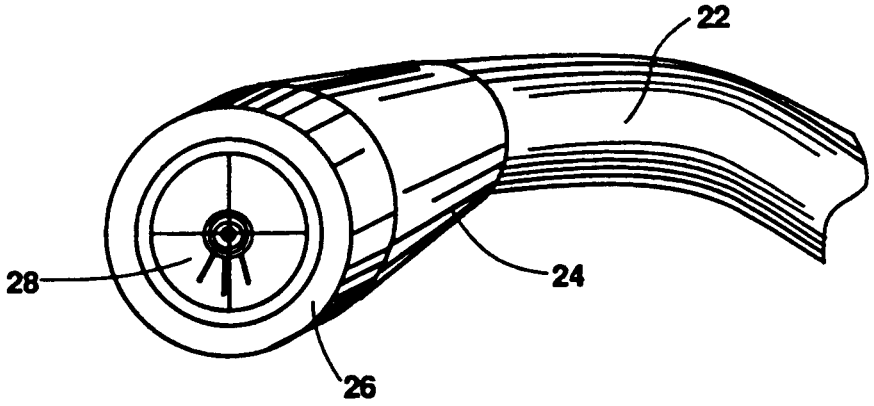
FIG. 2 is an enlarged scale view showing the viewing portion of the gunsight flexibility and variable distance aiming apparatus with the target in sight and lined up for accurate firing.

Referring to drawings in particular, the invention embodied therein comprises a firearm 10 such as a rifle or the like which includes a precision mount 12 and an optical sight 14 for aiming the firearm at an image or target such as target 16. The image produced by the optical gunsight 14 is normally viewed by lining up ones aiming eye with the rear end of the optical sight 14. According to the invention, a first coupling member including an ocular mechanism 18 and ocular mechanism 20 is provided for conditioning the optical image. Transmission means such as a flexible fiber optic trunk 22 is provided connected to the coupling means to transmit light or transmit a signal from the coupling to a viewing location which is spaced away from the optical gunsight 14. According to the first embodiment of the invention, the coupling means including ocular mechanisms 18 and 20 conditions the optical image received from the optical sight 14 such that it may be transmitted by the flexible fiber optic trunk 22. A second coupling arrangement including coupling means 24 is provided at the viewing location connected to the fiber optic trunk 22. The coupling arrangement 24 reconditions the light or signal for viewing at a viewer mechanism such as ocular 26. Accordingly, the viewer mechanism 26 provides an image 28 which directly corresponds to the image provided by the optical sight 14 (see FIG. 2). Attached to the viewer mechanism 26 is an attaching means 29 for securing the view mechanism 26 in close proximity to the aiming eye, via a hat, helmet, headband, or eye piece for example.

Figure 3:
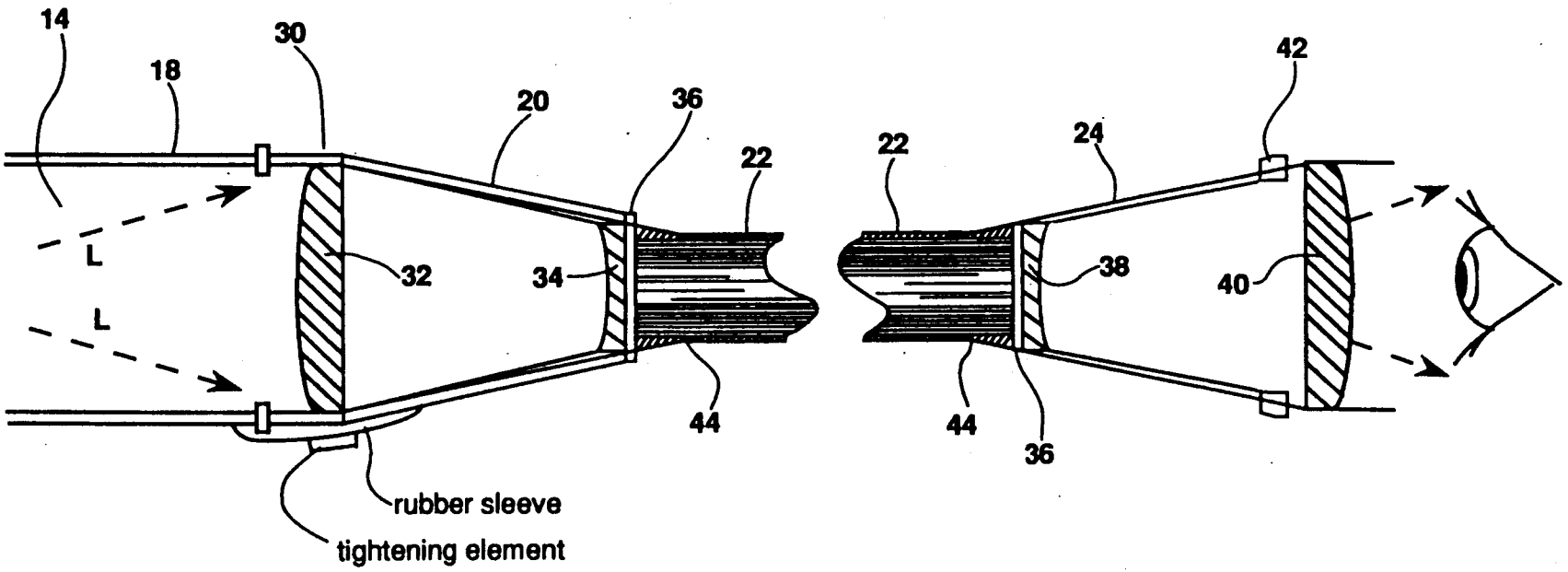
FIG. 3 is a cross sectional view showing a prefered configuration of optical lenses to enhance image transfer from a standard gunsight to the view via the fiber optic trunk.

Referring to FIG. 3 in particular, the coupling arrangement including ocular mechanisms 18 and 20 are shown in more detail. The coupling devices 18 and 20 include a connecting arrangement 30 which connects the conventional optical sight 14 and the coupling arrangement. The coupling arrangement includes lenses 32 and 34 such that light L from the virtual image produced by the gunsight 14 is focussed such that a smaller virtual image is introduced into the narrower fiber optic trunk 22 through transparent interface 36. The light of the smaller virtual image is transferred via the fiber optic trunk 22 without substantial loss through a second transparent interface 36 on the ocular end. At the ocular end of the trunk 22, the interface 36 introduces the virtual image 28 from the target 16 in its reduced state to the lenses 38 and 40 provided in the coupling arrangement 24. The coupling arrangement 24 then presents a magnified version of the previously reduced virtual image to the viewer. The viewing portion connected to the coupling arrangement 24 includes a focussing arrangement such as a telescoping device 42 for fine focussing of the ocular lenses within the second coupling arrangement 24. A coating 44 is provided about the flexible fiber optic trunk 22 to provide protection to the trunk during use.

Figure 4:
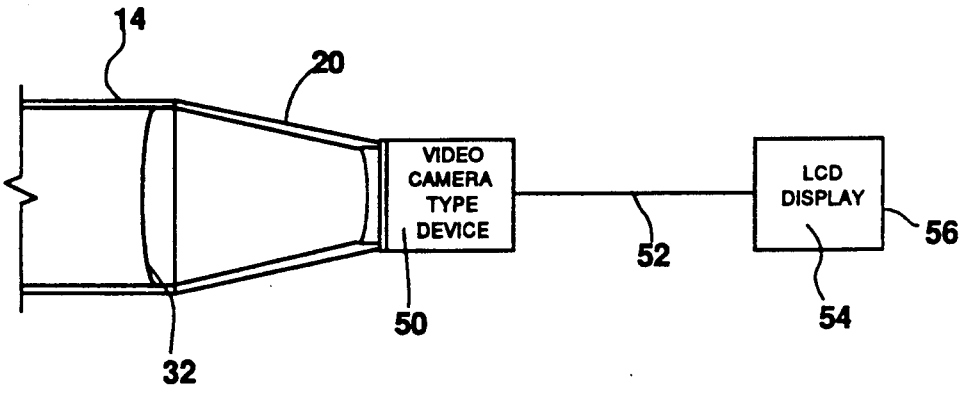
FIG. 4 is a cross sectional view similar to FIG. 3 showing an alternative embodiment of the invention.

According to an alternative arrangement of the invention as shown in FIG. 4, a first coupling arrangement 50 is provided connected to the standard optical sight 14. The coupling arrangement 50 receives light from the virtual image and converts the light into an electrical signal (video signal). The coupling arrangement 50 is connected to an electrical conductor 52 which transmits the signal representative of the image to a location spaced away from the optical sight 14. A second coupling arrangement 54 is provided connected to the electrical conductor 52. A second coupling arrangement 54 receives the electrical signal and converts the electrical signal via a viewer mechanism 56 for viewing by the user of the arrangement. The viewer mechanism 56 may be in the form of a LCD screen or a CRT screen.

Figure 5:
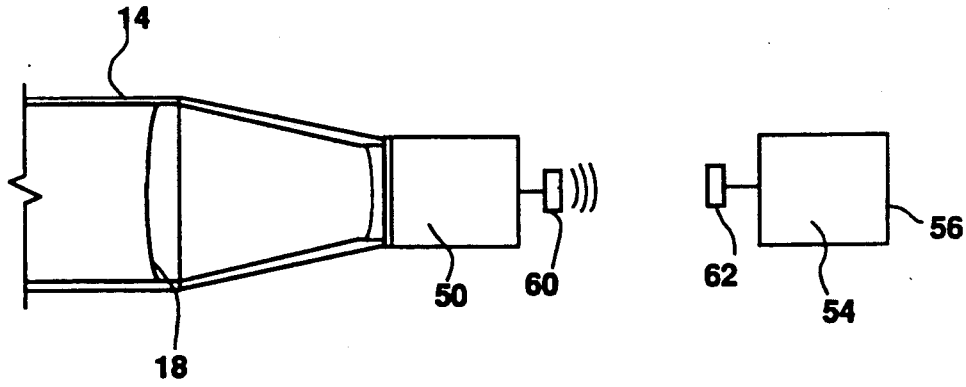
FIG. 5 is a cross-sectional view similar to FIG. 4 showing an alternative embodiment of the invention using a signal transmission means and a signal reception means.

According to still a further alternative of the invention as shown in FIG. 5, the electrical conductor 52 is replaced by a transmitter 60 connected to the first coupling arrangement 50 and a receiver 62 connected to the viewer mechanism 56. The electrical signal is passed to the transmitter and transmitted to the receiver where the electrical signal representing the image is converted to an image by the viewer mechanism 56.

While specific embodiments of the invention have been shown and described in detail to illustrate the application of the principles of the invention, it will be understood that the invention may be embodied otherwise without departing from such principles.

What is claimed is:

1. A self-contained gunsight arrangement, comprising:

an optical sight fixed to a firearm for providing an image of an object at which the firearm is directed;

coupling means, connected to said optical sight for receiving said image and outputting a conditioned image:

transmission means connected to said coupling means for receiving said conditioned image and transmitting said conditioned image to a location spaced away from said optical sight;

second coupling means connected to said transmission means for receiving said transmitted conditioned image and outputting a reconditioned image; and viewing means for viewing;

said transmission means is a flexible fiber optic trunk for transmitting light representing said conditioned image;

said first coupling means includes an ocular mechanism for reducing said image provided by said optical sight for transmission by said flexible fiber optic trunk;

said second coupling means includes an additional ocular mechanism for enlarging said image transmitted by said transmission means;

said additional viewer ocular mechanism includes means for adjusting the position of said viewer ocular mechanism with respect to said coupling means for adjusting the focus of an image visible through said viewing means.

* * * * *